US006186888B1

(12) United States Patent
Ohashi

(10) Patent No.: US 6,186,888 B1
(45) Date of Patent: Feb. 13, 2001

(54) SYSTEM AND METHOD FOR CONTROLLING VENTILATION IN A TUNNEL

(75) Inventor: Hiroyuki Ohashi, Tokyo (JP)

(73) Assignee: Kabushiki Kaisha Toshiba, Kawasaki (JP)

( * ) Notice: Under 35 U.S.C. 154(b), the term of this patent shall be extended for 0 days.

(21) Appl. No.: 09/414,702

(22) Filed: Oct. 8, 1999

(30) Foreign Application Priority Data

Oct. 8, 1998 (JP) ..... 10-285806

(51) Int. Cl.[7] ..... E21F 1/00
(52) U.S. Cl. ..... 454/167
(58) Field of Search ..... 454/166, 167

(56) References Cited

FOREIGN PATENT DOCUMENTS 4-198599 7/1992 (JP) .

OTHER PUBLICATIONS

"Intelligent Transport Systems (ITS) Handbook," Highway Industry Development Organization, Tokyo, Japan, Toyota Technical Review, vol. 46, No. 1, pp. 20–21 (1996).

Steven E. Shladover, "Review of the State of Development of Advanced Vehicle Control Systems," Vehicle Systems Dynamics: International Journal of Vehicle Mechanics and Mobility, vol. 24, Nos. 6–7, Jul. 1995, 551–595.

Todd Jochem and Dean Pemerleau, "Life in the Fast Lane: The Evolution of an Adaptive Vehicle Control System," Al Magazine, vol. 17, No. 2, Summer 1996, pp. 11–50.

Koyama et al., "Road Tunnel Ventilation Control Based on Nonlinear Programming and Fuzzy Control," T. IEE Japan, vol. 113–D, No. 2, 1993, pp. 160–168. An English abstract is being submitted with this document.

*Primary Examiner*—Harold Joyce
*Assistant Examiner*—Derek S. Boles
(74) *Attorney, Agent, or Firm*—Finnegan, Henderson, Farabow, Garrett & Dunner, L.L.P.

(57) ABSTRACT

A system and method are disclosed for controlling ventilation in a tunnel. According to the disclosed system and method, a set speed value for each vehicle traveling in the tunnel is determined based on the measured level of a physical phenomenon in the tunnel. The set speed value is communicated to each vehicle traveling in the tunnel and/or utilized to control a tunnel ventilator.

24 Claims, 4 Drawing Sheets

SYSTEM AND METHOD FOR CONTROLLING VENTILATION IN A TUNNEL

BACKGROUND OF THE INVENTION

I. Field of the Invention

The present invention generally relates to a system and method for controlling ventilation in a tunnel for automobiles. More particularly, the present invention relates to a system and method for controlling ventilation in the tunnel, which controls a speed of vehicles traveling in the tunnel and the density of air pollution.

II. Background and Material Information

A tunnel for automobiles is usually provided a ventilator to control air pollution inside the tunnel within a permissible range. Air pollution is caused by pollutants, such as soot and carbon monoxide (CO), which are ingredients of exhaust discharged by automobiles traveling in the tunnel. Although various methods of tunnel ventilating have been proposed, a representative method will be hereinafter described.

According to a past method, for example, as disclosed in T. Koyama et al., "Road Tunnel Ventilation Control Based on Nonlinear Programming and Fuzzy Control," Trans. IEE of Japan, Vol. 113-D, No.2, February 1993) there is a traffic counter by the roadside. A traffic volume forecasting unit employing a statistical method forecasts traffic volume in the tunnel at stated periods using a value measured by the traffic counter. A ventilation scheduling unit computes a plan value of the ventilator operation volume using the forecasted traffic volume. This plan value will be a base of ventilator operation volume in the next period.

There is also a visibility index meter (hereinafter referred to as a "VI meter") measuring the state of air pollution in the tunnel. A carbon monoxide meter (hereinafter referred to as a "CO meter") measuring CO density, and an air velocity meter (hereinafter referred to as an "AV meter") measuring air velocity in the tunnel are also provided. With a ventilation feedback control unit, a modification value of the ventilator operation volume is computed by using each value measured by the VI meter, the CO meter, and the AV meter. An operation instruction for a tunnel ventilator is determined by a harmonizing unit by harmonizing between the plan value and the modification value.

On the one hand, an automobile traveling in a tunnel produces pollutants, but on the other hand each automobile influences air velocity in the tunnel. This influence is called "ventilation by traffic". However, a ventilating capacity of the ventilation by traffic fluctuates at every moment, because the speeds of the automobiles are vary depending on each driver and are apt to fluctuate at any moment. As a result, both the air velocity and pollution density in the tunnel can fluctuate at any moment.

It is well-known that the volume of the pollutants discharged by an automobile depends on the open degree of a throttle of the automobile. Resulting from the speed fluctuations of the automobiles, the volume of the pollutants fluctuates every moment. As a result, the pollution density in the tunnel fluctuates every moment likewise.

With past approaches, such as with the method described above, and other past approaches (such as the system described in JP KOKAI 4-198599), it is very difficult to control the tunnel ventilator due to the frequent fluctuation of the pollution density in the tunnel. This is because of a mechanical restriction on starting and stopping of the ventilator, and the required time to improve the pollution density with the ventilator. Therefore, a target control value of the pollution density is usually set up on the fail-safe side. As a result, unnecessary consumption of electricity is required.

SUMMARY OF THE INVENTION

In view of the foregoing, the present invention is directed to a system and method for controlling ventilation in a tunnel that substantially obviates one or more of the problems due to limitations and disadvantages of the past approaches.

In accordance with an aspect of the present invention, as embodied and broadly described, the present invention is directed to a system for controlling ventilation in a tunnel. The system comprises at least one sensor for a measuring the level of a physical phenomenon in the tunnel, means for determining a set speed value for each vehicle traveling along at least one direction in the tunnel based on the level of the physical phenomenon measured by the sensor, and means for communicating the set speed value to each vehicle traveling in the tunnel.

In accordance with another aspect of the present invention, there is provided a method for controlling ventilation in a tunnel. The method comprises measuring the level of a physical phenomenon in the tunnel by a sensor, determining a set speed value for each vehicle traveling along at least one direction in the tunnel based on the level of the physical phenomenon measured by the sensor, and communicating the determined speed value to each vehicle traveling in the tunnel.

It is to be understood that both the foregoing general description and the following detailed description are exemplary and explanatory only and are not restrictive of the invention, as claimed. Further features and/or variations may be provided in addition to those set forth herein. For example, the present invention may be directed to various combinations and subcombinations of the disclosed features and/or combinations and subcombinations of several further features disclosed below in the detailed description.

BRIEF DESCRIPTION OF THE DRAWINGS

The accompanying drawings, which are incorporated in and constitute a part of this specification, illustrate various embodiments and/or features of the invention and together with the description, serve to explain the principles of the invention. In the drawings.

DETAILED DESCRIPTION

The various aspects and features of the present invention will be hereinafter described with reference to the accompanying drawings.

Figure 1:
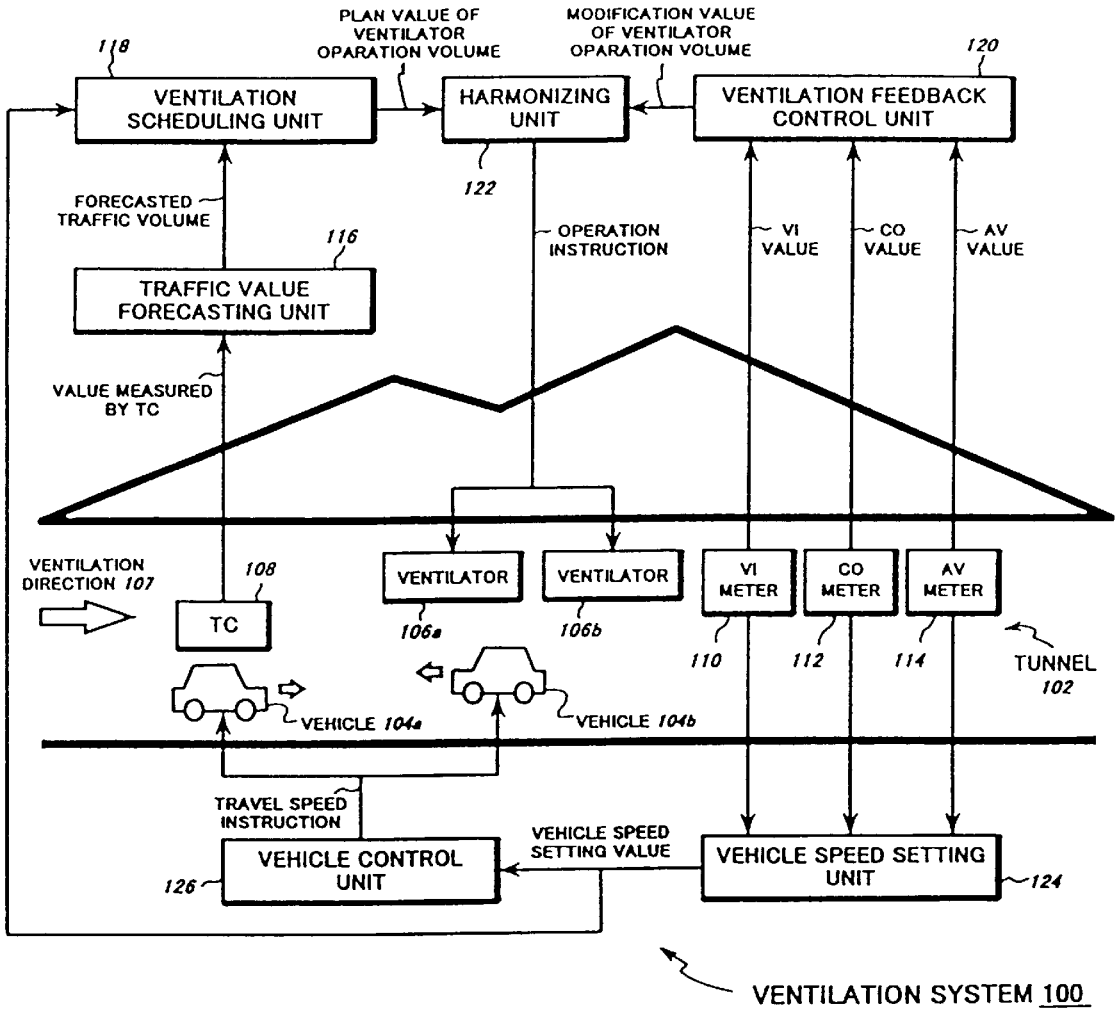
FIG. 1 is an exemplary block diagram showing the configuration of a ventilation system 100, according to the principles of the present invention.
Figure 2A:
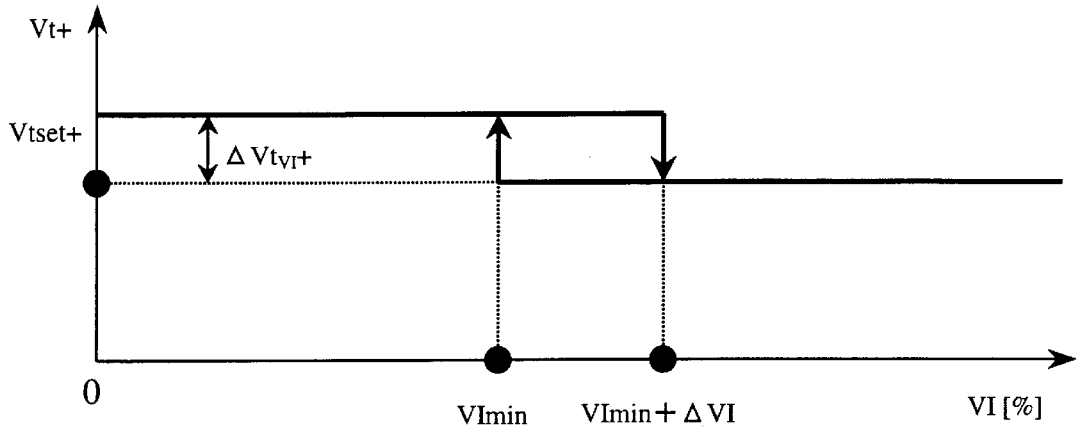
FIGS. 2(*a*) and 2(*b*) are exemplary diagrams illustrating a method of computing a proper vehicle speed setting value according to the VI value.
Figure 2B:
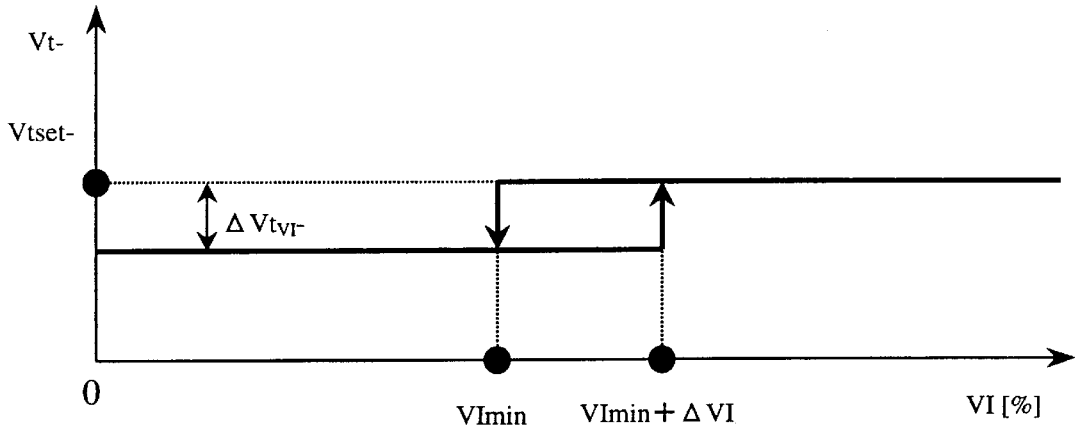
Figure 3A:
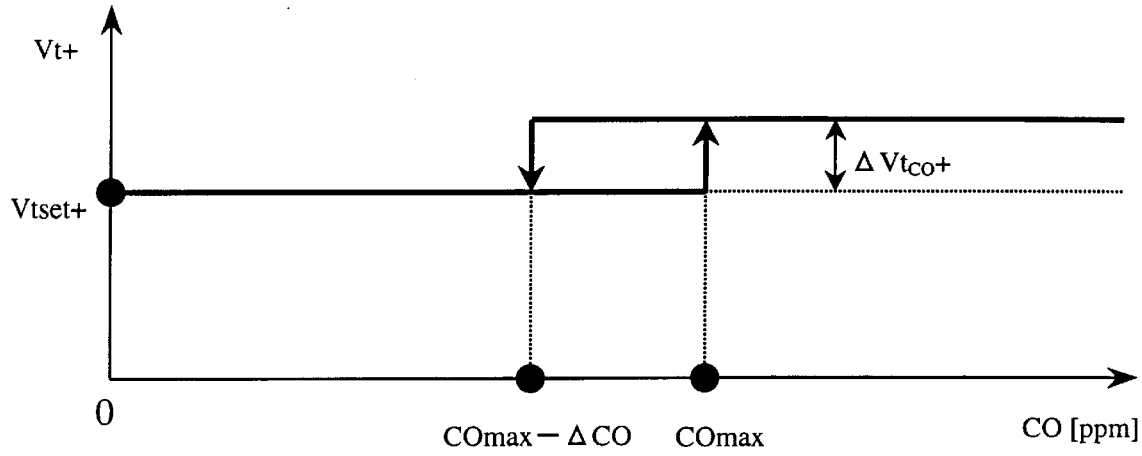
FIGS. 3(*a*) and 3(*b*) are exemplary diagrams illustrating a method of computing a proper vehicle speed setting value according to the CO value.
Figure 3B:
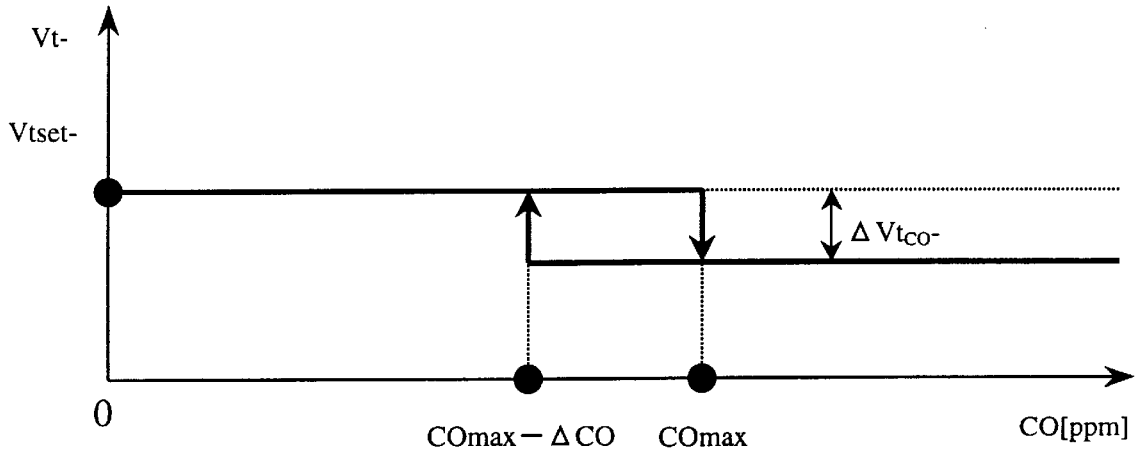
Figure 4A:
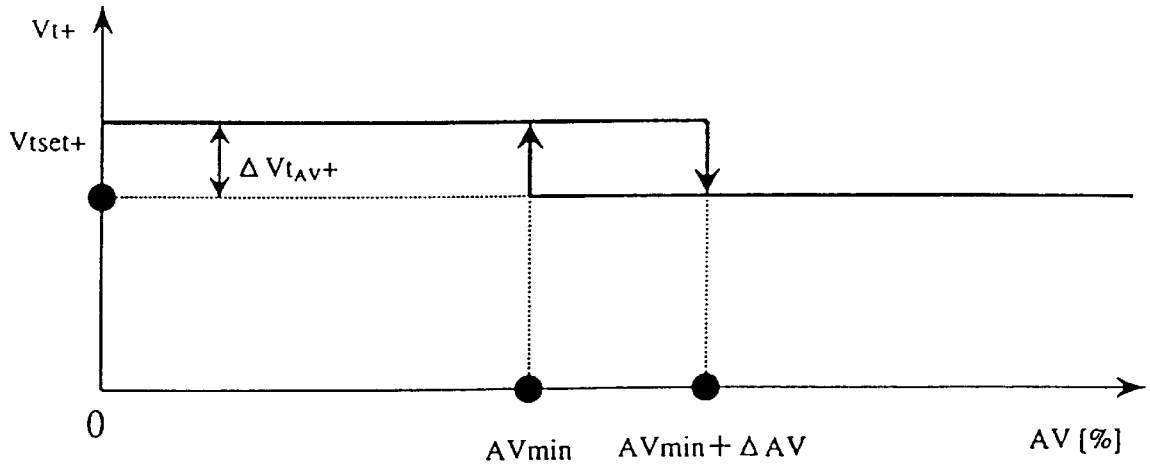
FIGS. 4(*a*) and 4(*b*) are exemplary diagrams illustrating a method of computing a proper vehicle speed setting value according to the AV value.
Figure 4B:
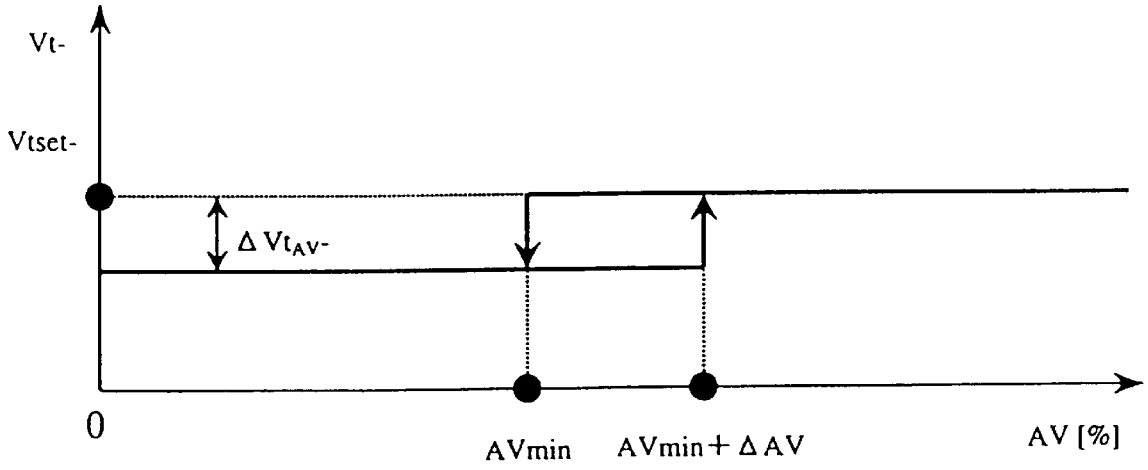

FIG. 1 is an exemplary block diagram showing the configuration of a ventilation system 100 according to the present invention. As illustrated in FIG. 1, a two-way road tunnel 102 has an up-lane for a vehicle 104*a* and a-down lane for a vehicle 104*b*. Tunnel 102 includes a longitudinal ventilation system that comprises ventilators 106*a* and 106*b*, such as jet fans. Ventilators 106*a*, 106*b* blow out polluted air from tunnel 102 along a ventilation direction 107. The jet fan longitudinal ventilation system is one of the most generally used ventilation methods in Japan. There are some cases where a dust collector and/or an intake fan and an exhaust fan are combined with ventilators 106 when tunnel 102 has a long length.

Various sensors provided in tunnel 102 will be hereinafter described. The sensors are classified broadly into two types; namely, those for measuring traffic volume and those for measuring a physical phenomenon in tunnel 102.

A traffic counter (hereinafter referred to as a "TC") 108 is employed as the former type of sensor for measuring traffic volume. TC 108 counts the number of vehicles 104 traveling in tunnel 102, and also measures speed of each vehicle 106*a*, 106*b* on the up-lane or down-lane. TC 108 may also detect each size of vehicle 106*a*, 106*b* (e.g., large or small) and provide a detailed count of the vehicles according to size-type.

On the other hand, there are sensors in tunnel 102 for measuring a state of air pollution and those for measuring air velocity in Tunnel 102 as the latter type of sensor. In particularly, a VI meter 110 and/or a CO meter 112 are employed as air pollution density sensor and a AV 114 meter is employed as the air velocity sensors. A VI value measured by the VI meter 110 is an index indicating visibility in tunnel 102; namely, the visibility 100% and 0%, respectively, correspond to complete clearness and complete darkness in tunnel 102.

The value measured by TC 108 is put into a traffic volume forecasting unit 116. Traffic forecasting unit 116 forecasts traffic volume in Tunnel 102 at predetermined periods. The forecasted traffic volume is provided as input to a ventilation scheduling unit 118 and used with a later-described vehicle speed setting value for computing a plan value of the ventilator operation volume. The VI value, the CO value, and the AV value are each provided as input to ventilation feedback control unit 120 and used for computing a modification value of the ventilator operation volume.

As illustrated in FIG. 1, both of the resultant plan value and modification value of the ventilator operation volume are provided as input to a harmonizing unit 122. Harmonizing unit 122 harmonizes these values and outputs an operation instruction to the ventilators 106*a*, 106*b*.

Next, main units for speed controlling of vehicles 104 traveling in tunnel 102 will be hereinafter described. A vehicle speed setting unit 124 sets or controls the speed of vehicles traveling in Tunnel 102 using the VI value, the CO value, and the AV value and by outputting a vehicle speed setting value to both the ventilation scheduling unit 118 and a vehicle control unit 126. Vehicle control unit 126 which is, for example, employed as part of in an automated highway system (hereinafter referred to as "AHS"). In such a case, vehicle control unit 126 outputs a travel speed instruction to each vehicle 104*a*, 104*b* capable of automatic driving according to an AHS. With AHS, the speed of each vehicle and the interval of vehicles traveling on the road is controlled by continuous communication with the vehicles. Additional information regarding AHS is available in: INTELLIGENT TRANSPORT SYSTEMS (ITS) HANDBOOK, by Highway Industry Development Organization, Tokyo, Japan, pages 20–21; REVIEW OF THE STATE OF DEVELOPMENT OF ADVANCED VEHICLE CONTROL SYSTEMS, by Steven E. Shladover in Vehicle System Dynamics: International Journal of Vehicle Mechanics and Mobility, Vol. 24, Nos. 6–7, pages 551–595, July 1995; and LIFE IN THE FAST LANE: THE EVOLUTION OF AN ADAPTIVE VEHICLE CONTROL SYSTEM, by Todd Jochem and Dean Pemerleau in AI Magazine, Vol. 17, No. 2, pages 11–50, Summer 1996. Alternatively, vehicle control unit 126 may display a warning sign indicating the travel speed instruction to each vehicle 104*a*, 104*b*.

If an AHS is employed, it is enough that a leaky coaxial (LCX) cable is provided by the roadside and that an LCX controller, a throttle actuator, and a brake actuator are provided in each vehicle 104*a*, 104*b*. Vehicle control unit 126 automatically sets the speed of vehicles 104*a*, 104*b* based on the vehicle speed setting value by communicating with the vehicle via the LCX cable.

Next, an exemplary method of determining the vehicle speed setting value on the basis of the values measured by VI meter, CO meter, and AV meter will be hereinafter described, with reference to FIGS. 2*a*, 2*b*, 3*a*, 3*b*, 4*a*, and 4*b*.

It is required to control ventilators 106*a*, 106*b* to keep the VI value and the CO value in tunnel 102 within a predetermined permissible range. In a two-way road tunnel, sudden lowering of air velocity and reverse of wind direction are apt to occur owing to the fluctuation of the ventilation by traffic. As a result, the pollution density increases widely. The air velocity is kept at more than a specific standard irrespective of the pollution density to avoid this wide increase of the pollution density. Control values used in this function are as follows.

VI min: a lower limit of VI value; ventilators 106*a*, 106*b* are controlled not to make the VI value lower than this value.

CO max: an upper limit of CO value; ventilators 106*a*, 106*b* are controlled not to make the CO value more than this value.

AV min: a lower limit of AV value; ventilators 106*a*, 106*b* are controlled not to make the AV value lower than this value.

Speeds of vehicles 104 are defined as follows.

Vt+: a speed of vehicles 104*a* traveling along the ventilation direction 107.

Vt−: a speed of vehicles 104*b* traveling along the opposite direction of the ventilation direction 107.

Under normal conditions, Vt+ and Vt− are set about a legal speed. When Vt+ is set higher than Vt−, the ventilation by traffic along the ventilation direction 107 strengthens, and the ventilation by traffic along the opposite direction of the ventilation direction 107 weakens. As a result, electricity is saved. Setting values of Vt+ and Vt− under normal conditions are respectively defined as Vt set+ and Vt set−.

In accordance with the present invention, vehicle speed setting unit 124 computes the proper Vt set+ and Vt set− on the basis of the VI value, the CO value, and the AV value. A first example of this computing method will be hereinafter described referring to FIGS. 2(*a*) and 2(*b*).

FIGS. 2(*a*) and 2(*b*) are exemplary diagrams showing a method of computing a proper vehicle speed setting value according to the VI value. When the VI value is higher than VI min, Vt+ and Vt− are respectively set at Vt set+ and Vt set−. When the VI value becomes lower than VI min, resulting for example from a changing for the worse of the air pollution density, Vt+ is increased by $\Delta Vt_{VI+}$ and Vt− is decreased by $\Delta Vt_{VI-}$.

Accordingly, the ventilation by traffic along the ventilation direction 107 strengthens and the ventilation by traffic along the opposite direction of the ventilation direction 107 weakens. As a result, ventilation ability of the ventilators 106*a,* 106*b* is supported by the ventilation by traffic.

When the VI value exceeds VI min+ΔVI owing to the operation of the ventilators 106*a,* 106*b,* both Vt+ and Vt− are respectively restored to Vt set+ and Vt set−. ΔVI is a parameter used for making a hysteresis loop, as shown in FIGS. 2(*a*) and 2(*b*). This hysteresis loop prevents frequent change of the vehicle speed.

A second example of the computing method for the vehicle speed setting value will be hereinafter described referring to FIGS. 3(*a*) and 3(*b*).

FIGS. 3(*a*) and 3(*b*) are exemplary diagrams showing a method of computing proper vehicle speed setting value according to the CO value. When the CO value is lower than CO max, Vt+ and Vt− are respectively set at Vt set+ and Vt set−. When the CO value becomes higher than CO max, resulting for example from a changing for the worse of the air pollution density, Vt+ is increased by ΔVt CO+ and Vt− is decreased by ΔVt CO−. As a result, ventilation ability of the ventilators 106*a,* 106*b* is supported by the ventilation by traffic in the way as shown in FIGS. 3(*a*) and 3(*b*).

When the CO value becomes lower than CO max−ΔCO owing to the operation of the ventilators 106*a,* 106*b,* both Vt+ and Vt− are respectively restored to Vt set+ and Vt set−. ΔCO is a parameter used for making a hysteresis loop, as shown in FIGS. 3(*a*) and 3(*b*). This hysteresis loop prevents frequent change of the vehicle speed.

A third example of the computing method for the vehicle speed setting value will be hereinafter described referring to FIGS. 4(*a*) and 4(*b*).

FIGS. 4(*a*) and 4(*b*) are exemplary diagrams showing a method of computing proper vehicle speed setting value according to the AV value. When the AV value is higher than AV min, Vt+ and Vt− are respectively set at Vt set+ and Vt set−. When the AV value becomes lower than AV min, resulting for example from a changing for the worse of the air pollution density, Vt+ is increased by ΔVt AV+ and Vt− is decreased by ΔVt AV−. ΔAV is a parameter used for making a hysteresis loop shown in FIGS. 4(*a*) and 4(*b*). As a result, ventilation ability of the ventilators 106*a,* 106*b* is supported by the ventilation by traffic in the way as shown in FIGS. 4(*a*) and 4(*b*).

When the AV value becomes higher than AV min+ΔAV owing to the operation of the ventilators 106*a,* 106*b,* both Vt+ and Vt− are respectively restored to Vt set+ and Vt set−. This hysteresis prevents frequent change of the vehicle speed.

As described above, Vt+ and Vt− are corrected on the basis of the VI value, the CO value, and/or the AV value. If two or more values are in need of changing in the same period, Vt+ and Vt− are determined in consideration of all values. For example, when the VI value becomes lower than VI min and the AV value becomes lower than AV min, Vt+ and Vt− are computed as follows. Vt+ and Vt− should have an upper limit Vt max and a lower limit Vt min, for example, according to the legal speed:

$$Vt+=Vt\ \text{set}++\Delta Vt\ \text{VI}++\Delta Vt\ \text{AV}+$$

$$Vt-=Vt\ \text{set}--\Delta Vt\ \text{VI}--\Delta Vt\ \text{AV}-$$

Thus vehicle speed setting unit 124 computes the vehicle speed setting value and outputs to both the ventilation scheduling unit 118 and vehicle control unit 126. The reason why the vehicle speed setting value is used for computing the plan value of the ventilator operation volume is described below.

In conventional tunnel ventilation systems, an actually measured value and/or a value forecasted at the designing stage of the road are used as a vehicle speed. Therefore, the plan value of the ventilator operation volume includes a comparatively big error. However, precision of the plan value can be remarkably improved using exact vehicle speeds, namely, Vt+ and Vt− determined by vehicle speed setting unit 124. Because ventilation scheduling unit 118 takes account of the generated volume of soot and CO, which depend on the throttle-open-degree, during determining of the plan value of the ventilator operation volume, ventilation scheduling unit 118 can compute a more exact plan value.

Consistent with the principles of the present invention, speeds of vehicles 104*a,* 104*b* traveling in tunnel 102 are controlled to be a certain value. Therefore, the fluctuation of ventilation by traffic is remarkably reduced and the fluctuation width of the air velocity and the air pollution density respectively become narrower. As a result, it is not necessary to allow for a margin for operation volume and the operation volume is reduced to save energy.

Further, consistent with the principles of the present invention, the fluctuation of the generated volume of the pollutants depending on the vehicle speeds and the fluctuation width of the pollution density becomes narrower. As a result, it is not necessary to allow for a margin for operation volume and the operation volume is reduced to save energy.

Moreover, consistent with the principles of the present invention, when the change the pollution density for the worse or decline of the air velocity are generated, the vehicle speed setting values are changed; namely, the ventilation by traffic along the ventilating direction is strengthen and the ventilation by traffic along the opposite direction is weaken likewise. As a result, the operation of the ventilator is assisted and operation value of the ventilator is reduced to save energy.

Other embodiments of the present invention will be apparent to those skilled in the art from consideration of the specification and practice of the invention disclosed herein. It is intended that the specification and examples be considered as exemplary only, with a true scope and spirit of the present invention being indicated by the following claims.

What is claimed is:

1. A system for controlling ventilation in a tunnel, comprising:

at least one sensor for a measuring the level of a physical phenomenon in the tunnel;

means for determining a set speed value for each vehicle traveling along at least one direction in the tunnel based on the level of the physical phenomenon measured by the sensor; and means for communicating the set speed value to each vehicle traveling in the tunnel.

2. The system of claim 1, wherein the sensor measures the level of air pollution density in the tunnel.

3. The system of claim 1, wherein the sensor measures the level of visibility in the tunnel.

4. The system of claim 1, wherein the sensor measures the level of CO density in the tunnel.

5. The system of claim 1, wherein the sensor measures the level of air velocity in the tunnel.

6. The system of claim 1, wherein:

the tunnel comprises two lanes which are respectively along a ventilating direction and along a direction opposite to the ventilating direction; and the speed determining means sets the speed value of each vehicle traveling along the ventilating direction higher than the speed of each vehicle traveling along the opposite direction when the level measured by the sensor deviates from a predetermined range.

7. The system of claim 1, further comprising:

at least one ventilator for ventilating air in the tunnel;

a ventilation scheduling unit that computes a plan value for the ventilator based on the set speed value.

8. The system of claim 7, further comprising means for forecasting traffic volume in the tunnel, wherein the ventilation scheduling unit determines the plan value for the ventilator based on the forecasted traffic volume.

9. The system of claim 7, wherein the sensor measures the level of air pollution density in the tunnel.

10. The system of claim 7, wherein the sensor measures the level of visibility in the tunnel.

11. The system of claim 7, wherein the sensor measures the level of CO density in the tunnel.

12. The system of claim 7, wherein the sensor measures the level of air velocity in the tunnel.

13. A method for controlling ventilation in a tunnel, comprising:

measuring the level of a physical phenomenon in the tunnel by a sensor;

determining a set speed value for each vehicle traveling along at least one direction in the tunnel based on the level of the physical phenomenon measured by the sensor; and communicating the determined speed value to each vehicle traveling in the tunnel.

14. The method of claim 13, wherein said measuring the level of a physical phenomenon includes measuring the level of air pollution density in the tunnel.

15. The method of claim 13, wherein said measuring the level of a physical phenomenon includes measuring the level of visibility in the tunnel.

16. The method of claim 13, wherein said measuring the level of a physical phenomenon includes measuring the level of CO density in the tunnel.

17. The method of claim 13, wherein said measuring the level of a physical phenomenon includes measuring the level of air velocity in the tunnel.

18. The method of claim 13, wherein the tunnel comprises two lanes which are respectively along a ventilating direction and along a direction opposite to the ventilating direction, said method further comprising:

setting the speed value of each vehicle traveling along the ventilating direction higher than the speed of each vehicle traveling along a direction opposite to the ventilating direction when the level measured by the sensor deviates from a predetermined range.

19. The method of claim 13, further comprising:

ventilating air in the tunnel by at least one ventilator; and computing a plan value for the ventilator based on the set speed value.

20. The method of claim 19, further comprising forecasting traffic volume in the tunnel; and computing a plan value for the ventilator based on the forecasted traffic volume.

21. The method of claim 19, wherein said measuring the level of a physical phenomenon includes measuring the level of air pollution density in the tunnel.

22. The method of claim 19, wherein said measuring the level of a physical phenomenon includes measuring visibility in the tunnel.

23. The method of claim 19, wherein said measuring the level of a physical phenomenon includes measuring CO density in the tunnel.

24. The method of claim 19, wherein said measuring the level of a physical phenomenon includes measuring air velocity in the tunnel.

* * * * *

UNITED STATES PATENT AND TRADEMARK OFFICE

CERTIFICATE OF CORRECTION

PATENT NO. : 6,186,888 B1
DATED : February 13, 2001
INVENTOR(S) : Hiroyuki Ohashi It is certified that error appears in the above-identified patent and that said Letters Patent is hereby corrected as shown below:

Column 6, claim 1,
Line 48, before "measuring", delete "a".

Signed and Sealed this

Eighteenth Day of December, 2001

*Attest:*

*Attesting Officer*

JAMES E. ROGAN
*Director of the United States Patent and Trademark Office*